US008083208B2

(12) United States Patent
Li

(10) Patent No.: US 8,083,208 B2
(45) Date of Patent: Dec. 27, 2011

(54) GAS ROTARY VALVE

(76) Inventor: Xueya Li, Zhejiang (CN)

( * ) Notice: Subject to any disclaimer, the term of this patent is extended or adjusted under 35 U.S.C. 154(b) by 219 days.

(21) Appl. No.: 12/684,821

(22) Filed: Jan. 8, 2010

(65) Prior Publication Data

US 2011/0037007 A1 Feb. 17, 2011

(30) Foreign Application Priority Data

Aug. 11, 2009 (CN) ..... 2009 1 0101746

(51) Int. Cl.
*F16K 5/02* (2006.01)

(52) U.S. Cl. ..... 251/207; 251/310

(58) Field of Classification Search ..... 251/207, 251/208, 209, 310, 312, 286, 96; 137/555, 137/625.47
See application file for complete search history.

(56) References Cited

U.S. PATENT DOCUMENTS 2,101,356 A * 12/1937 Zak ..... 251/207
2,665,107 A * 1/1954 Blackford ..... 251/96
3,292,660 A * 12/1966 Zarybnicky ..... 137/599.17
3,693,874 A * 9/1972 Fox ..... 236/15 A
3,712,580 A * 1/1973 Shopsky ..... 251/96
3,764,102 A * 10/1973 Shopsky ..... 251/96
4,029,291 A * 6/1977 Carlson ..... 251/96
4,137,945 A * 2/1979 Cutts ..... 137/625.46
4,862,917 A * 9/1989 Genbauffe ..... 137/599.17
5,277,221 A * 1/1994 Amaya ..... 137/454.6
6,520,481 B2 * 2/2003 Harneit ..... 251/207
6,863,257 B2 * 3/2005 Home ..... 251/209
7,156,370 B2 * 1/2007 Albizuri ..... 251/207

* cited by examiner

*Primary Examiner* — John Fristoe, Jr.
*Assistant Examiner* — Andrew J Rost
(74) *Attorney, Agent, or Firm* — Global IP Services; Tianhua Gu

(57) ABSTRACT

A gas rotary valve comprises a valve body (1), a valve core (2), a valve cover (3), an actuating shaft (4) and a regulator positioning pin (6). The valve core (2) has a large through hole (22), a first small through hole (23) and a second small through hole (24) which are all disposed on a peripheral surface of said valve core (2). A guide pin (41) radially disposed on the rear end of the actuating shaft (4), a first step (3*a;*3*c*), the rear end (61) of the regulator positioning pin (6) and a second step (3*b;*3*d*) are disposed in distance in the inner chamber of said valve cover (3), respectively preventing the guide pin (41) from rotating. The three through holes on the peripheral surface of the valve core can respectively be communicated with the inlet passage of the valve body.

8 Claims, 8 Drawing Sheets

GAS ROTARY VALVE

CROSS REFERENCE TO RELATED PATENT APPLICATION

The present application claims the priority of the Chinese patent application No. 200910101746.0 filed on Aug. 11, 2009 which is incorporated herein by reference.

FIELD OF THE INVENTION

The present invention relates to a kind of gas rotary valve, especially to a kind of a gas rotary valve which can adjust the corresponding gas passage according to the different gas supplies.

DESCRIPTION OF THE PRIOR ART

The gas rotary valve in varies of gas appliance is a manual valve to control the gas supply. The common gas rotary valve is only fit for one gas supply. And the common gas rotary valve generally comprises a valve body including an inlet passage and an outlet passage, a valve core with a gas passage disposed in the valve body and an actuating shaft. Usually, a nozzle is jointed with the end of the outlet passage of the valve body when used, and the user can operate the actuating shaft through a control knob which is disposed on a panel, and can make the valve core rotate to make the gas passage of the valve core be communicated with the inlet passage of the valve body. At this time, the gas can pass through the inlet passage, the outlet passage and spray out from the nozzle to supply for the gas appliance.

Nowadays, multiple new energy sources are exploited and used, then the phenomenon of unitary energy sources changes. For example, the liquefied petroleum gas, natural gas and dimethyl ether are concurrently used as gas supplies widely. When different type of gas supply is concurrently used and should be exchanged each other, the above stated common gas rotary valve will not be fit any more. Then, a gas rotary valve which can provide multiple gas passage and can exchange each other will be required.

For example, in U.S. Pat. No. 7,156,370, a gas rotary valve which can adjust multiple gas passage to match with different type of gas supply is disclosed. The gas rotary valve in this U.S. patent comprises a valve body, an actuating shaft and a rotary regulator organ. The valve body has an inlet conduit, an out let conduit and a housing for the regulator organ. The actuating shaft is mounted salient from a control panel on the cooking appliance. And an interchangeable control knob is disposed on the free end of the actuating shaft, and is provided with a lug which can be inserted into the control panel of the appliance. The rotary regulator organ is provided with a revolution peripheral surface and multiple peripheral through openings which can respectively be communicated with the center hole of the valve core, the multiple peripheral through openings and the inlet passage of the valve body all locate on the same section. The peripheral through openings on the valve core can respectively be communicated with the inlet passage of the valve body, so that, the gas flow can pass the center hole of the valve core and directly flow to the outlet passage of the valve body, to provide gas supply for the cooking appliance.

In this patent, the peripheral through openings on the valve core is composed of a large through opening, an intermediate through opening, a first small through opening and a second small through opening, providing multiple passages with different caliber. The control knob can rotate relatively to the panel and the valve body, and can make the actuating shaft and valve core rotate. The control knob can positioning rotate from a beginning position where the valve is in condition of closed, the angle of positioning rotating is fit for the position of the peripheral through openings on the valve core.

A circular slide groove is formed on the panel, and the angle of the circular slide groove just match to the angle of the first small through opening relatively to the beginning position. When the control knob is rotating, the bottom lug will slide in the circular slide groove, finally, the lug will resist the end of the circular slide groove and be limited, and then the first small through opening is communicated with the inlet passage.

A radial pin which can guide for the valve core to rotate is disposed on the rear end of the actuating shaft. When the control knob drives the actuating shaft rotate, the radial pin can resist the groove of the valve cover and be limited, then the second small through opening is communicated with the inlet passage.

It can be seen that, the positioning means is the circular slide groove on the panel, the radial pin on the actuating shaft and the groove on the valve cover. But, the common panel in the present cooking appliance is in plane. The panel has a small hole corresponding to the control knob for the top of the actuating shaft to insert, it is to make the top of the actuating shaft be jointed with the control knob. But, the panel has no groove around the small hole, therefore, the panel in the U.S. patent should be specially made to form the groove. Moreover, the radial pin should be formed at the rear end of the control knob, then the present panel and control knob can not be fit for the gas rotary valve, it will reduce the fitness of the panel and control knob, and increase the cost of manufacture obviously.

At the same time, the circular slide groove on the panel not only makes the appearance of cooking appliance uglier, but also makes the water, soupy and crumb on the panel easy drop into the valve. It at least makes the valve dirty, when the deposit of the smudge is heavy, it is possible to make the gas rotary valve cannot work even.

In the above stated subject, the panel and the gas rotary valve should cooperate with each other, to make each opening limited at the accurately position. It requires the precise matching between the panel and the valve when assembling. It makes the manufacture and assembling more difficult. Moreover, the panel and the gas rotary valve are respectively manufactured by two different factories actually, commonly, the panel is manufactured by the cooking appliance factory, and the gas rotary valve is manufactured by the valve factory. It will cause big difficulty to assure the precision of manufacture of two products.

On the other hand, nowadays there is short of energy sources. In many countries, the gas supply of whole block should be frequently replaced. As the difference of the gas supply will cause the difference of the quantity of flow required by the gas appliance, so that the initial common gas rotary valve which is only fit for one type of gas supply should be replaced. For the above stated technology, the whole gas rotary valve and the whole cooking appliance should be replaced. So the cost of changing is very high. It is not benefit for the generalization and applying of new gas supply, and not benefit for the enforcement of work of changing to new gas supply.

SUMMARY OF THE INVENTION

It is an object of the present invention to provide a gas rotary valve, in which, each through hole on the peripheral surface of the valve core can be communicated with the inlet passage of the valve body one by one, without the limit of the special panel and the special control knob, so that the current panel and the current control knob can be fit for the gas rotary valve. It will markedly improve the manufacture precision and be benefit for the reducing of the cost.

For achieving this object, the gas rotary valve comprising:

a valve body including an inlet passage and an outlet passage;

a valve core with a center hole disposed in said valve body and being rotatable relatively to said valve body, having a large through hole, a first small through hole and a second small through hole which are all disposed on a peripheral surface of said valve core and communicated with said center hole respectively;

a valve cover disposed at an end of the valve body;

an actuating shaft for driving said valve core to synchronously rotate in the single direction, a rear end of the actuating shaft going through a center hole of said valve cover and inserting into a round inner chamber of said valve cover, a guide pin radially fixed on the rear end of said actuating shaft, said actuating shaft being movable inward and outward relatively to said valve cover;

wherein a first step and a second step disposed in distance in the inner chamber of said valve cover, respectively preventing said guide pin from rotating, the positions of the two steps matching the following condition: at the turn of said guide pin on said actuating shaft is stopped by said first step, said large through hole on said valve core communicates with said inlet passage of the valve body; at the turn of said guide pin on said actuating shaft is stopped by said second step, said second small through hole on said valve core communicates with said inlet passage of the valve body;

a regulator positioning pin, a rear end of which being able to enter into the inner chamber of said valve cover, the rear end of said regulator positioning pin being located between said first step and said second step, the position of the rear end of said regulator positioning pin matching the following condition: at the turn of said guide pin on said actuating shaft is stopped by the rear end of said regulator positioning pin, said first small through hole on said valve core communicates with said inlet passage of the valve body.

The regulator positioning pin can be designed to be that, the rear end of the regulator positioning pin can be inserted into the inner chamber of the valve cover or be drawn from the inner chamber of the valve cover under the control by hand. For example, being inserted or drawn in line or in screw. When applied only in the exchange of two gas supplies, the regulator positioning pin can be simply designed to be drawn completely.

The first step and the second step can be any structure forming edges to resist the guide pin. Preferably, the first step and the second step can be the structure as follows: a high-low complex step is formed in the round inner chamber of the valve cover, the high-low complex step is composed of a first circular arc and a second circular arc, the first circular arc is a low step and the second circular arc is a high step, a beginning edge of the first circular arc is the first step, and a border between the first circular arc and the second circular arc is the second step.

Preferably, the first step and the second step also can be the structure as follows: a first block and a second block are projected in distance in the round inner chamber of the valve cover, the second block is higher than the first block, and a beginning edge of the first block is the first step, and a beginning edge of the second block is the second step.

In order to improve the seal capability between the regulator positioning pin and the valve cover, a seal ring can be disposed between the regulator positioning pin and the valve cover.

It can adopt any existing art to make the valve core synchronously rotate with the valve actuating shaft driven by the valve actuating shaft. Preferably, to make the structure of the components simpler, a spring can be disposed between a bottom of the actuating shaft and the valve core, a recess is formed on the valve core, and the guide pin of the actuating shaft can be inserted into the recess of the valve core.

Compared with the prior art, in this present invention, the regulator positioning pin is designed to be inserted in the inner chamber of the valve cover, then, a new limiting portion is formed in the round inner chamber of the valve cover. The regulator positioning pin, the first step and the second step in the valve cover become three limiting components which can respectively resist the guide pin. Concretely, the guide pin can respectively be resisted by the first step, the rear end of the regulator positioning pin, and the second step being limited, therefore, the three through hole on the peripheral surface of the valve core can respectively be communicated with the inlet passage of the valve body.

The above stated method in the present invention will not use the panel and the control knob anymore. It will make the current panel and control knob can be fit for the gas rotary valve and make the panel much clean.

Moreover, the exchange of two gas supplies only lie on one gas rotary valve of the present invention, it can reduce the difficulty of manufacture of the mechanism for the exchange of gas supplies in large degree, and the mechanism for the exchange of gas supplies can be finished only in one factory. It will markedly improve the manufacture precision and assembly, and it will also be benefit for the reducing of the cost.

Besides, if the gas rotary valve of the present invention is used, when the exchange of gas supplies occurs, the single operation should be done is to adjust or draw the regulator positioning pin, without changing the whole gas rotary valve. Therefore, the cost of replacement the gas rotary valve can be saved, and it will be benefit for smoothly generalizing the new gas supply.

DETAILED DESCRIPTION OF THE PREFERRED EMBODIMENT

Figure 1:
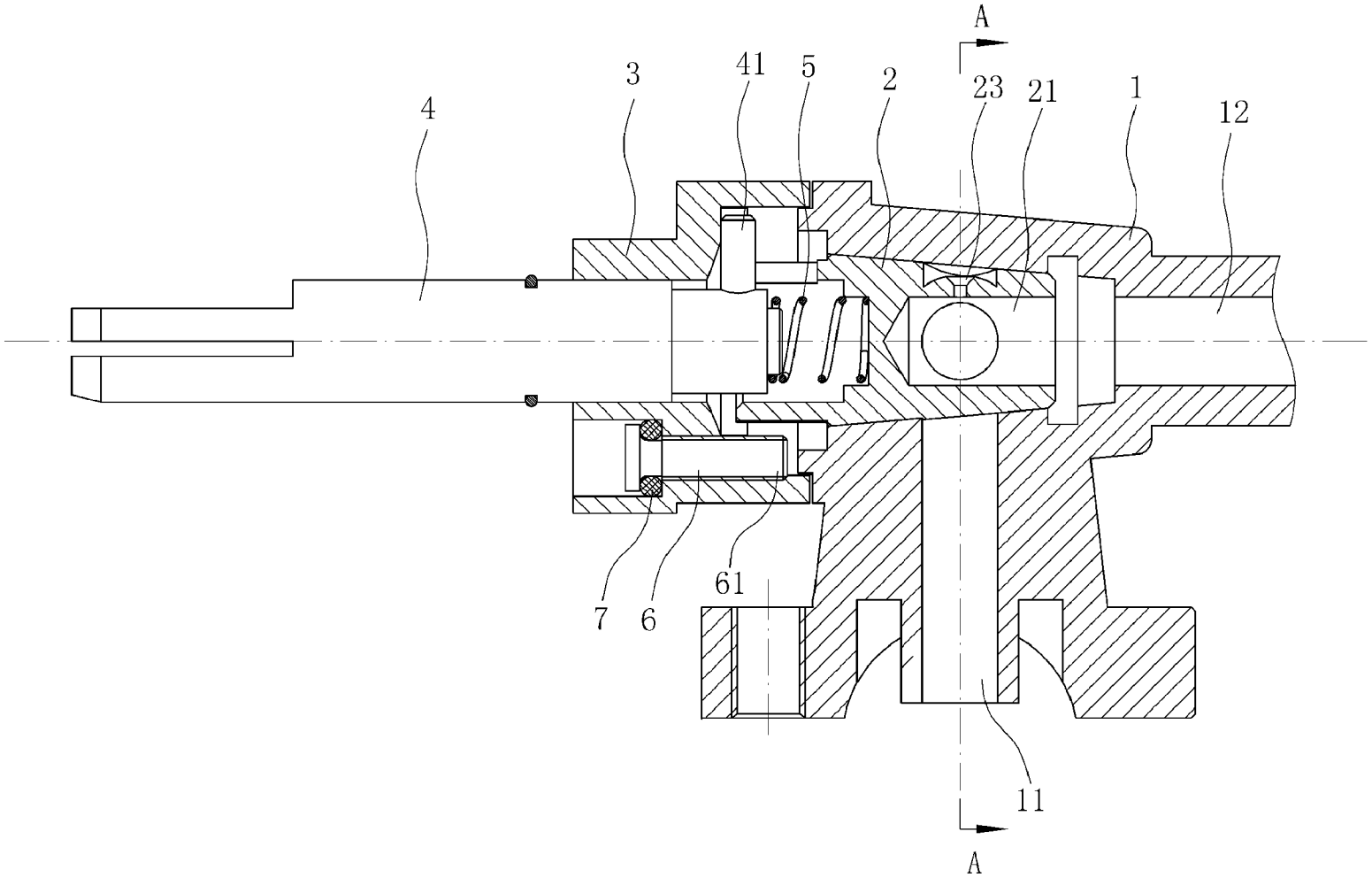
FIG. 1 is a section view of the gas rotary valve in accordance with a first exemplary embodiment of the present invention.

To enable a further understanding of the innovative and technological content of the invention herein, refer to the detailed description of the invention and the accompanying drawings below:

FIG. 1 to FIG. 11 show the first embodiment of the present invention.

In this embodiment, the gas rotary valve comprises:

a valve body 1, which includes an inlet passage 11 and an outlet passage 12;

a valve core 2 with a center hole 21, which is disposed in the valve body 1 being rotatable relatively to the valve body 1, and has a large through hole 22, a first small through hole 23 and a second small through hole 24 which are all disposed on a peripheral surface of the valve core 2 and communicated with the center hole 21 respectively;

a valve cover 3 disposed at an end of the valve body 1;

an actuating shaft 4 for driving the valve core 2 to synchronously rotate in the single direction, a rear end of the actuating shaft 4 going through a center hole 31 of the valve cover 3 and inserting into a round inner chamber of the valve cover 3, and a guide pin 41 radially fixed on the rear end of the actuating shaft 4, the actuating shaft 4 being movable inward and outward relatively to the valve cover 3.

To make the valve core 2 synchronously rotate with the valve actuating shaft 4 driven by the actuating shaft 4, a spring 5 is disposed between a bottom of the actuating shaft 4 and the valve core 2, a recess is formed on the valve core 2, and the guide pin 41 of the actuating shaft 4 can be inserted into the recess of the valve core 2.

A first step 3*a* and a second step 3*b* are disposed in distance in the inner chamber of the valve cover 3, respectively preventing the guide pin 41 from rotating. Concretely, a high-low complex step is formed in the round inner chamber of the valve cover 3, the high-low complex step is composed of a first circular arc 32 and a second circular arc 33, the first circular arc 32 is a low step and the second circular arc 33 is a high step, a beginning edge of the first circular arc 32 is the first step 3*a*, and a border between the first circular arc 32 and the second circular arc 33 is the second step 3*b*.

An inserted hole 34 is formed on the first circular arc 32 of the valve cover 3. The rear end of a regulator positioning pin 6 goes through the inserted hole 34 and enters into the inner chamber of the valve cover 3, the rear end of the regulator positioning pin 6 just locates between the first step 3*a* and the second step 3*b*. Besides, a seal ring 7 is disposed between the regulator positioning pin 6 and the valve cover 3.

Figure 2:
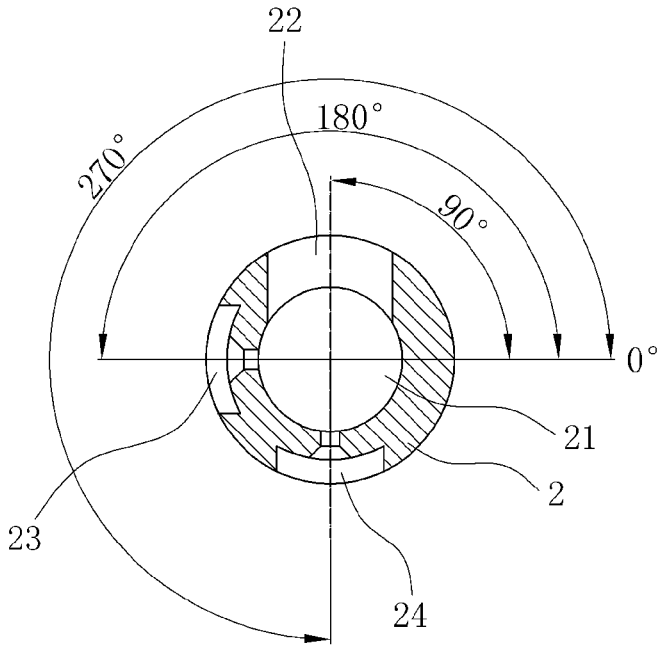
FIG. 2 is a section view of the valve core of the first exemplary embodiment of the present invention.
Figure 3:
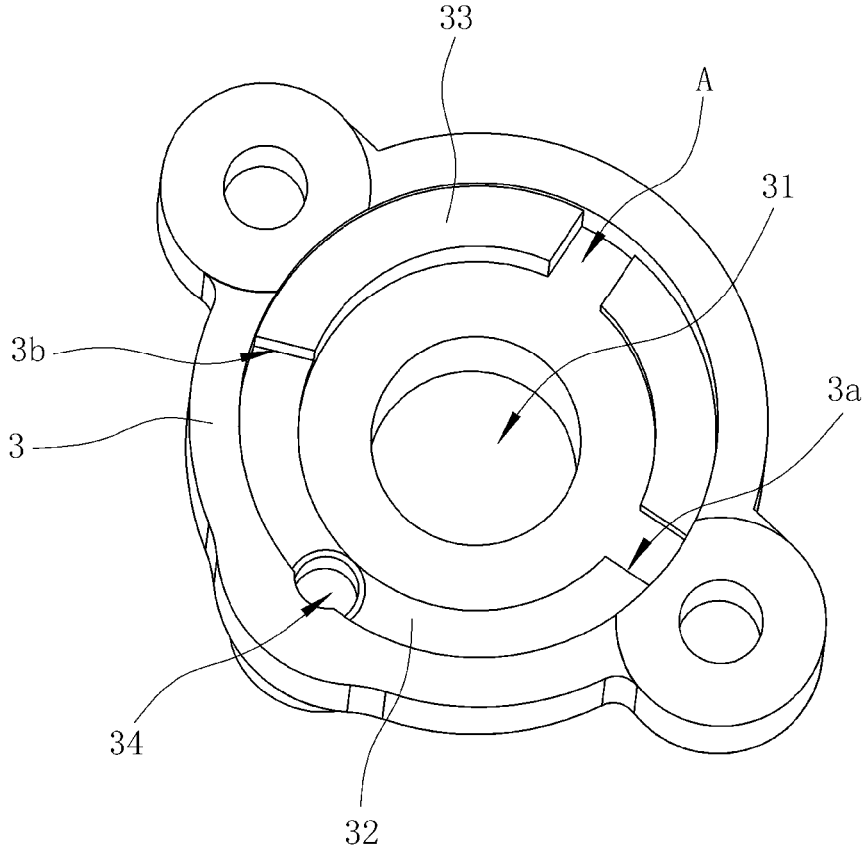
FIG. 3 is a perspective view of the valve cover of the first exemplary embodiment of the present invention.
Figure 4:
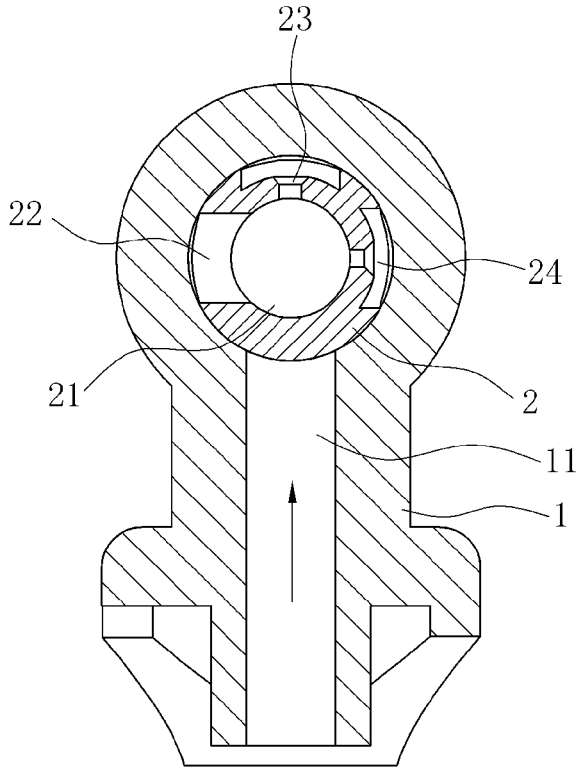
FIG. 4 is the sectional view of A-A way of FIG. 1, when the valve body and the valve core are at the situation that the valve is initially closed.
Figure 5:
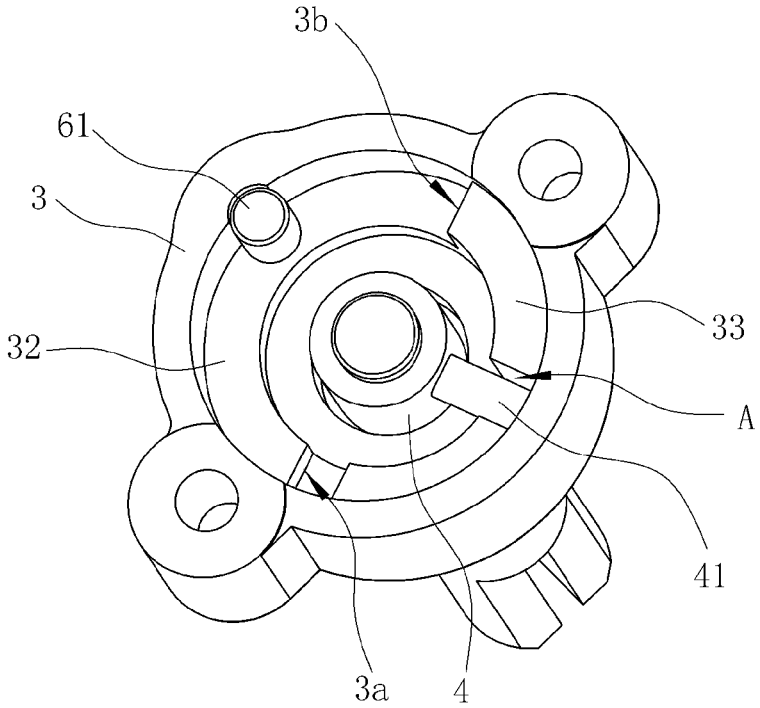
FIG. 5 is a perspective view of the valve cover and the actuating shaft when the valve is initially closed.

As shown in FIG. 4 and FIG. 5, when the gas rotary valve is initially closed, any through hole on the valve core 2 is not communicated with the inlet passage 11 of the valve body 1. While the guide pin 41 of the actuating shaft 4 locates at a beginning position A to begin rotate. The guide pin 41 which will rotate relatively to the valve cover 3, is supposed at the location of 0 degree, while the valve core 2 which will rotate relatively to the valve body 1, is just supposed at the location of 0 degree, as shown in FIG. 2.

In this embodiment, the first step 3*a* is disposed at the location of 90 degree along the direction of the actuating shaft 4 rotates anticlockwise, and the large through hole 22 of the valve core 2 is also disposed at the location of 90 degree along the direction of the actuating shaft 4 rotates anticlockwise. The rear end 61 of the regulator positioning pin 6 is disposed at the location of 180 degree along the direction of the actuating shaft 4 rotates anticlockwise, and the first small through hole 23 on the valve core 2 is also disposed at the location of 180 degree along the direction of the actuating shaft 4 rotates anticlockwise. The second step 3*b* is disposed at the location of 270 degree along the direction of the actuating shaft 4 rotates anticlockwise, and the second small through hole 24 on the valve core 2 is also disposed at the location of 270 degree along the direction of the actuating shaft 4 rotates anticlockwise, as shown in FIG. 2.

Figure 6:
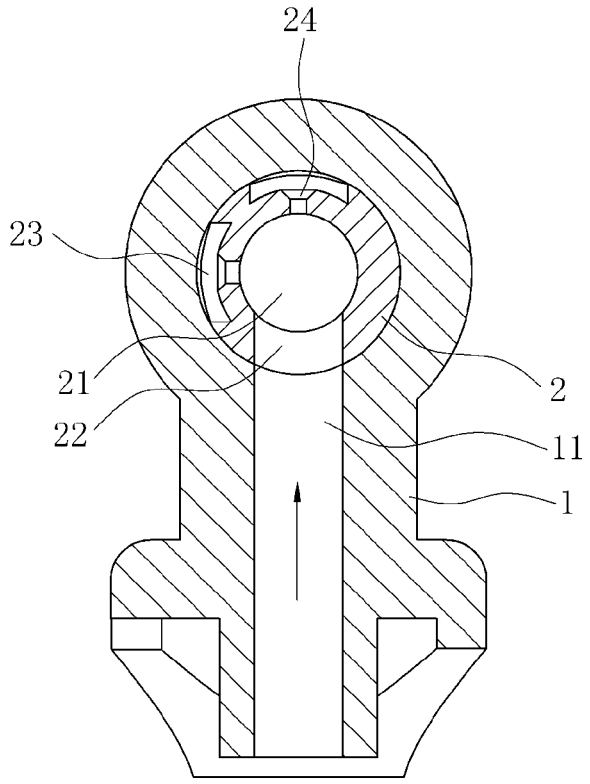
FIG. 6 is the sectional view of A-A way of FIG. 1, when the large through hole is communicated with the inlet passage.
Figure 7:
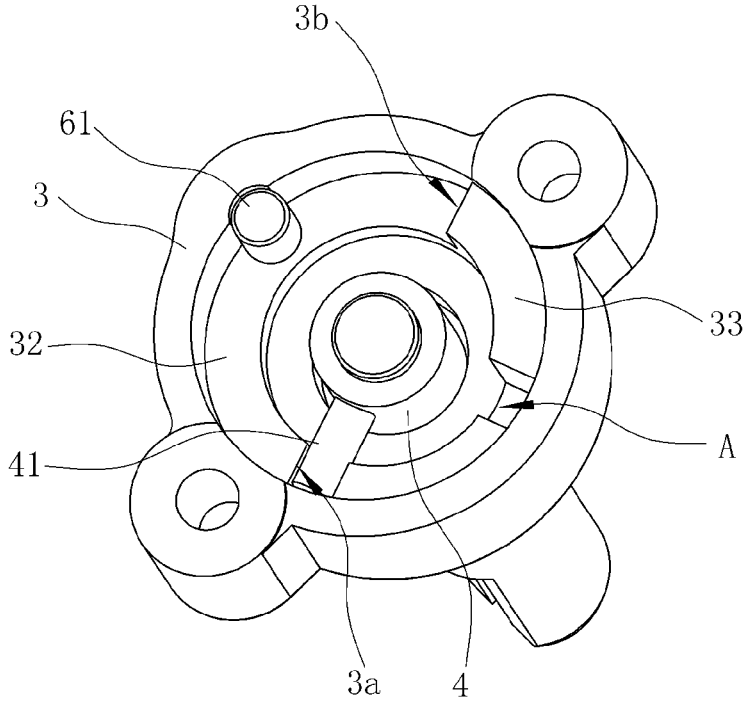
FIG. 7 is a perspective view of the valve cover and the actuating shaft when the large through hole is communicated with the inlet passage.

When the actuating shaft 4 is operated to be made rotate anticlockwise relatively to the valve body 1 and valve cover 3, the actuating shaft 4 will drive the valve core 2 synchronously rotate. When the guide pin 41 on the actuating shaft 4 rotates to the location of 90 degree, the guide pin 41 will be stopped by the first step 3*a*. At this time, the large through hole 22 on the valve core 2 just communicates with the inlet passage 11 of the valve body 1, as shown in FIG. 6 and FIG. 7.

Figure 8:
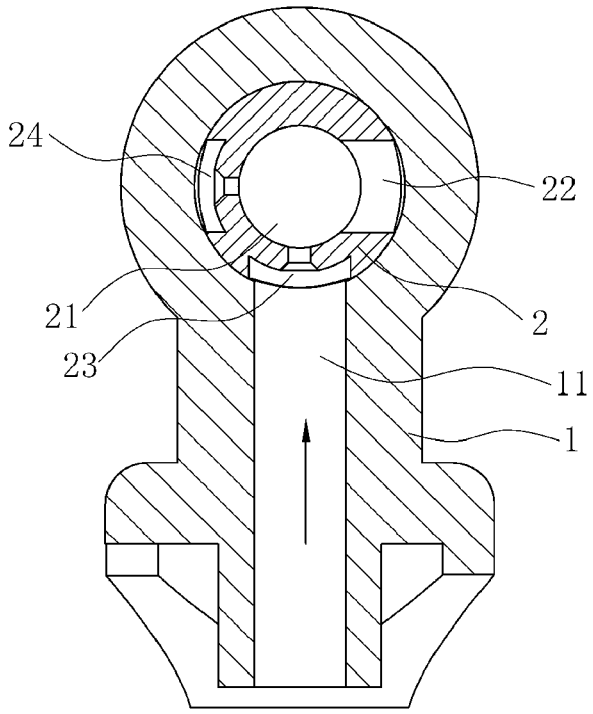
FIG. 8 is the sectional view of A-A way of FIG. 1, when the first small through hole is communicated with the inlet passage.
Figure 9:
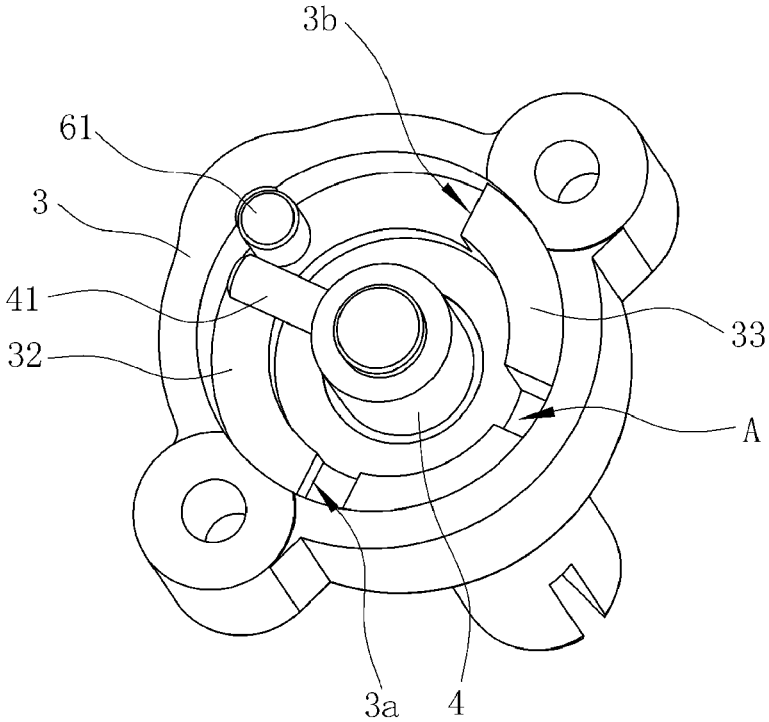
FIG. 9 is a perspective view of the valve cover and the actuating shaft when the first small through hole is communicated with the inlet passage.

When the actuating shaft 4 is pressed down, the guide pin 41 on the actuating shaft 4 can get across the first step 3*a* and continue rotating. When the guide pin 41 on the actuating shaft 4 rotates to the location of 180 degree, the guide pin 41 will be stopped by the rear end 61 of the regulator positioning pin 6. At this time, the first small through hole 23 on the valve core 2 just communicates with the inlet passage 11 of the valve body 1, as shown in FIG. 8 and FIG. 9.

Figure 10:
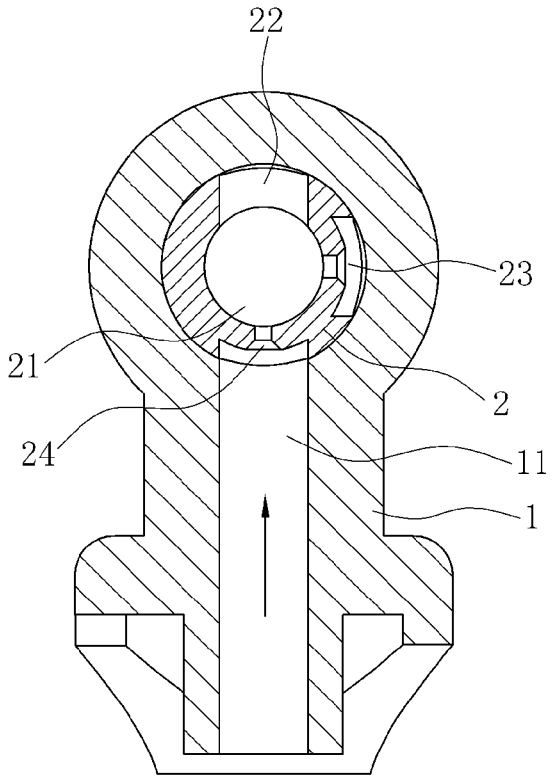
FIG. 10 is the sectional view of A-A way of FIG. 1, when the second small through hole is communicated with the inlet passage.
Figure 11:
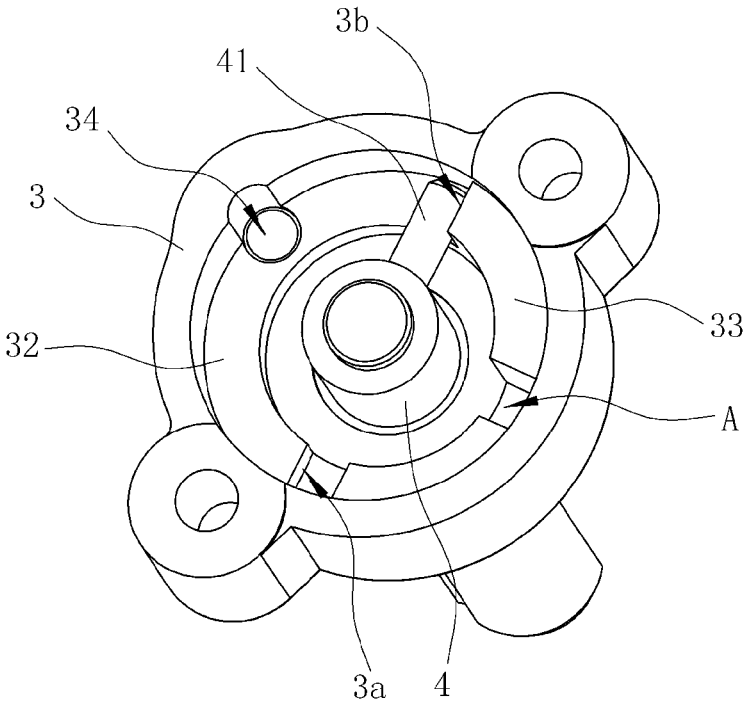
FIG. 11 is a perspective view of the valve cover and the actuating shaft when the second small through hole is communicated with the inlet passage.

When the regulator positioning pin 6 is drawn, the guide pin 41 on the actuating shaft 4 can continue rotating. When the guide pin 41 rotates to the location of 270 degree, the guide pin 41 will be stopped by the second step 3*b*. At this time, the second small through hole 24 on the valve core 2 just communicates with the inlet passage 11 of the valve body 1, as shown in FIG. 10 and FIG. 11.

Figure 12:
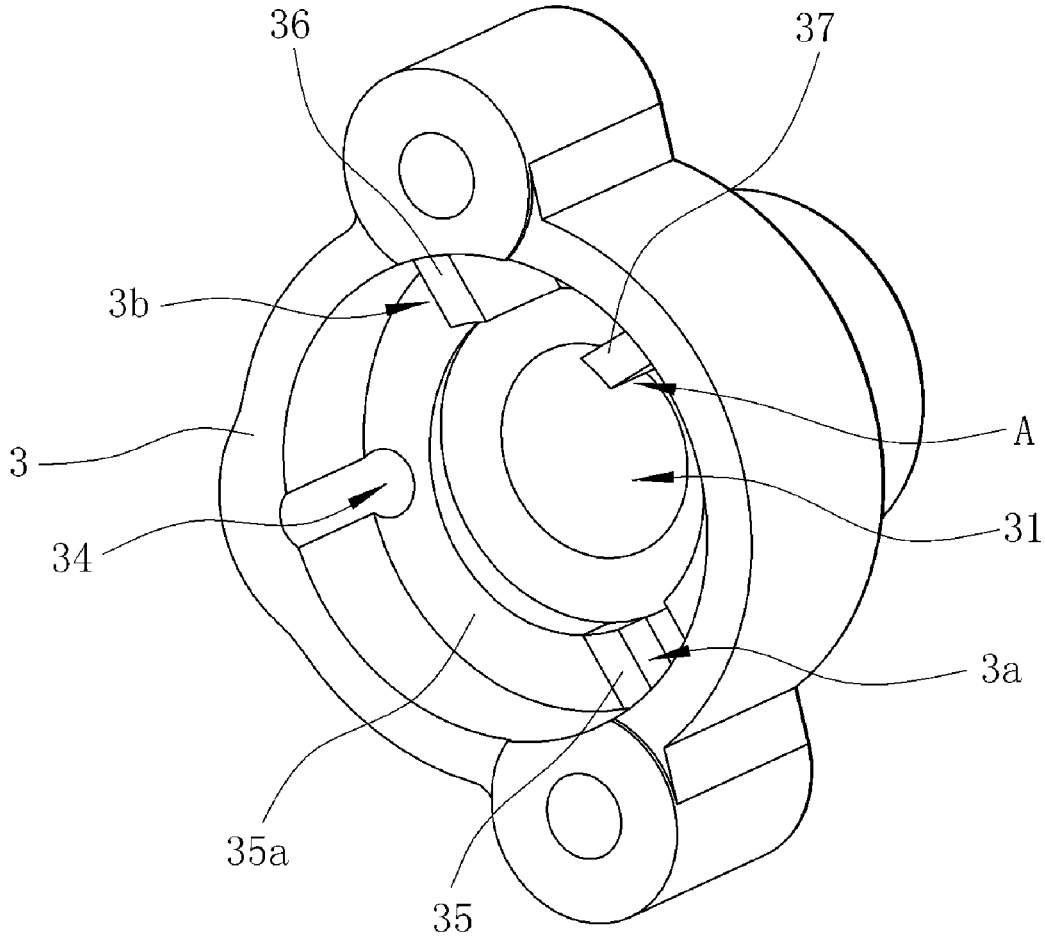
FIG. 12 is a perspective view of the valve cover of the second exemplary embodiment of the present invention.

FIG. 12 shows the second embodiment of the present invention. The gas rotary valve in the second embodiment is basically the same as the first embodiment mentioned above. The difference of the second embodiment compared with the first embodiment is the structure of the first step and the second step.

That is, a first block 35, a second block 36 and a third block 37 are projected at interval in the round inner chamber of the valve cover 3, the second block 36 is higher than the first block 35, and the beginning edge of the first block 35 is the first step 3*a*, while the beginning edge of the second block 36 is the second step 3*b*.

Furthermore, a slope 35*a* is disposed between the first block 35 and the second block 36, the slope 35*a* heightens gradually and smoothly from the side of the second step 3*b* of the second block 36 to the first block 35. So that, when the valve is closed, the guide pin 41 on the actuating shaft 4 will not be blocked by the first block and can successfully return back to the beginning position A.

Figure 13:
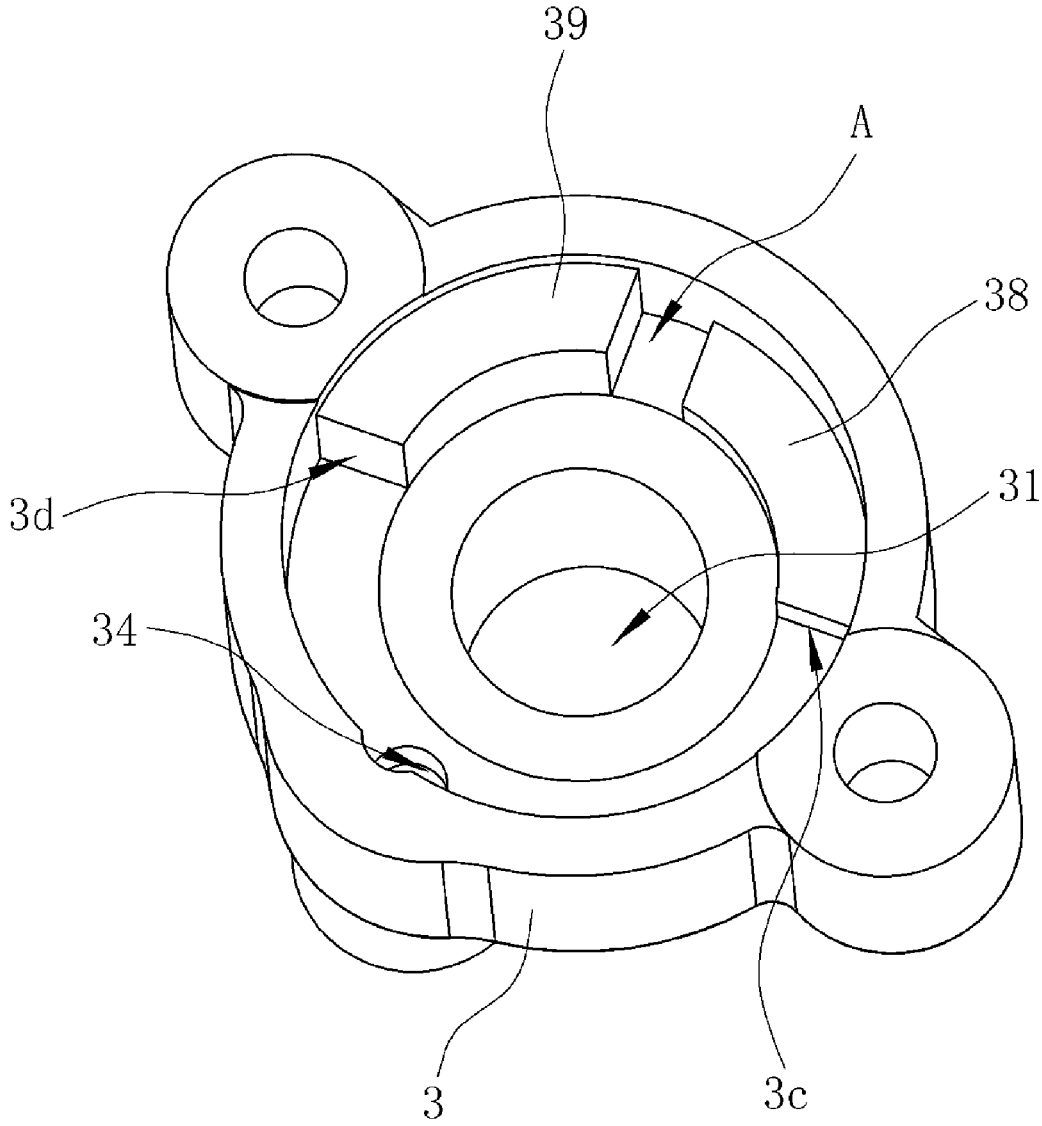
FIG. 13 is a perspective view of the valve cover of the third exemplary embodiment of the present invention.

The FIG. 13 shows the third embodiment of the present invention.

The difference of the third embodiment compared with the first embodiment is the structure of the first step and the second step. That is, a third circular arc 38 and a fourth circular arc 39 are formed in the round inner chamber of the valve cover 3. Wherein, the third circular arc 38 and the fourth circular arc 39 are respectively disposed in distance being adjacent. The groove, formed between the third circular arc 38 and the fourth circular arc 39, becomes the beginning position A of the guide pin 41 on the actuating shaft 4 when the valve is closed. And the fourth circular arc 39 is higher than the third circular arc 38, then the end edge of the third circular arc 38 is the first step 3*c*, and the beginning edge of the fourth circular arc 39 is the second step 3*d*.

What is claimed is:

1. A gas rotary valve comprising:

a valve body (1) including an inlet passage (11) and an outlet passage (12);

a valve core (2) with a center hole (21) disposed in said valve body (1) and being rotatable relatively to said valve body (1), having a large through hole (22), a first small through hole (23) and a second small through hole (24) which are all disposed on a peripheral surface of said valve core (2) and communicated with said center hole (21) respectively;

a valve cover (3) disposed at an end of the valve body (1);

an actuating shaft (4) for driving said valve core (2) to rotate in the single direction, a rear end of the actuating shaft going through a center hole (31) of said valve cover (3) and inserting into a round inner chamber of said valve cover (3), a guide pin (41) radially fixed on the rear end of said actuating shaft (4), said actuating shaft (4) being movable inward and outward relatively to said valve cover (3); wherein a first step (3*a*;3*c*) and a second step (3*b*;3*d*) disposed in distance in the inner chamber of said valve cover (3) respectively preventing said guide pin (41) from rotating, the positions of the two steps matching the following condition: at a turn of said guide pin (41) on said actuating shaft (4) is stopped by said first step (3*a*;3*c*) said large through hole (22) on said valve core (2) communicates with said inlet passage (11) of the valve body (1); at the turn of said guide pin (41) on said actuating shaft (4) is stopped by said second step (3*b*;3*d*), said second small through hole (24) on said valve core (2) communicates with said inlet passage (11) of the valve body (1);

a regulator positioning pin (6), a rear end of which being able to enter into the inner chamber of said valve cover (3), the rear end of said regulator positioning pin (6) being located between said first step (3*a*;3*c*) and said second step (3*b*;3*d*), the position of the rear end of said regulator positioning pin (6) matching the following condition: at the turn of said guide pin (41) on said actuating shaft (4) is stopped by the rear end (61) of said regulator positioning pin (6) said first small through hole (23) on said valve core (2) communicates with said inlet passage (11) of the valve body (1).

2. The gas rotary valve of claim 1, wherein a high-low complex step is formed in the round inner chamber of the valve cover (3), the high-low complex step is composed of a first circular arc (32) and a second circular arc (33), the first circular arc (32) is a low step and the second circular arc (33) is a high step, a beginning edge of the first circular arc (32) is the first step (3*a*), and a border between the first circular arc (32) and the second circular arc (33) is the second step (3*b*).

3. The gas rotary valve of claim 2, wherein a spring (5) is disposed between a bottom of the actuating shaft (4) and the valve core (2), a recess is formed on the valve core (2), and the guide pin (41) of the actuating shaft (4) can be inserted into the recess of the valve core (2).

4. The gas rotary valve of claim 1, wherein a first block (35) and a second block (36) are projected in distance in the round inner chamber of the valve cover (3), the second block (36) is higher than the first block (35), and a beginning edge of the first block (35) is the first step (3*a*), and a beginning edge of the second block (36) is the second step (3*b*).

5. The gas rotary valve of claim 4, wherein a spring (5) is disposed between a bottom of the actuating shaft (4) and the valve core (2), a recess is formed on the valve core (2), and the guide pin (41) of the actuating shaft (4) can be inserted into the recess of the valve core (2).

6. The gas rotary valve of claim 1, wherein a seal ring (7) is disposed between the regulator positioning pin (6) and the valve cover (3).

7. The gas rotary valve of claim 6, wherein a spring (5) is disposed between a bottom of the actuating shaft (4) and the valve core (2), a recess is formed on the valve core (2), and the guide pin (41) of the actuating shaft (4) can be inserted into the recess of the valve core (2).

8. The gas rotary valve of claim 1, wherein a spring (5) is disposed between a bottom of the actuating shaft (4) and the valve core (2), a recess is formed on the valve core (2), and the guide pin (41) of the actuating shaft (4) can be inserted into the recess of the valve core (2).

* * * * *